US006899606B2

(12) United States Patent
Liao et al.

(10) Patent No.: US 6,899,606 B2
(45) Date of Patent: May 31, 2005

(54) ROTARY GRINDING MACHINE

(76) Inventors: Juei-Seng Liao, No. 195, Sec. 1, Nanking E. Rd., Taichung City (TW); Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 10/794,835

(22) Filed: Mar. 5, 2004

(65) Prior Publication Data

US 2004/0180614 A1 Sep. 16, 2004

(30) Foreign Application Priority Data

Mar. 6, 2003 (TW) ..... 092203410
Mar. 6, 2003 (TW) ..... 092203414

(51) Int. Cl.[7] ..... B24B 1/00

(52) U.S. Cl. ..... 451/184; 451/296; 451/321; 198/813; 474/133; 144/177.1

(58) Field of Search ..... 451/182, 188, 451/178, 207, 130, 184, 236, 336, 300, 294, 310, 309, 301, 304, 321, 280, 298, 296; 198/840, 813; 474/133; 144/177.1

(56) References Cited

U.S. PATENT DOCUMENTS 2,909,074 A * 10/1959 Scheiterlein ..... 474/86
3,271,909 A * 9/1966 Rutt et al. ..... 451/1
3,435,566 A * 4/1969 Enserink ..... 451/59
3,718,168 A * 2/1973 Berends ..... 144/117.1
3,832,807 A * 9/1974 Kiser et al. ..... 451/300
3,946,861 A * 3/1976 Sandefur ..... 198/810.04
4,941,864 A * 7/1990 Bottum ..... 474/133
5,531,636 A * 7/1996 Bissen ..... 451/130
5,582,539 A * 12/1996 Wang ..... 451/188
5,720,648 A * 2/1998 Green et al. ..... 451/8
6,106,388 A * 8/2000 Green ..... 451/297
6,322,432 B1 * 11/2001 Wang ..... 451/361

* cited by examiner

*Primary Examiner*—George Nguyen
(74) *Attorney, Agent, or Firm*—DLA Piper Rudnick Gray Cary US LLP

(57) ABSTRACT

A rotary grinding machine includes a rotary grinding member for grinding a workpiece on a workpiece feeding member. The grinding member is coupled with an output shaft of a motor through a drive transmission mechanism. The feeding member is coupled with the output shaft of the motor through a reduction gear mechanism, a transmission shaft and an endless tensible transmission member. To maintain an operating tension of the tensible transmission member when the feeding member is moved relative to the grinding member, a tensioning mechanism is disposed to enable effective transmission of a drive force from the reduction gear mechanism to the feeding member.

11 Claims, 14 Drawing Sheets

ROTARY GRINDING MACHINE

CROSS-REFERENCE TO RELATED APPLICATION

This application claims priority of Taiwanese Application Nos. 092203414 and 092203410, both filed on Mar. 6, 2003.

BACKGROUND OF THE INVENTION

1. Field of the Invention

This invention relates to a rotary grinding machine, more particularly to a rotary grinding machine which includes a workpiece feeding member and a rotary grinding member that are driven by the same motor.

2. Description of the Related Art

Referring to FIGS. 1 and 2, a conventional grinding machine is shown to include a base frame 1, a feeding member 2 mounted on the base frame 1 for supporting a workpiece 11 thereon, a first motor 21 for driving the feeding member 2, a grinding member 3 mounted above the feeding member 2, a second motor 31, and an elevating member 4.

The grinding member 3 includes a housing 32 and a sanding drum 33 received in the housing 32. An output shaft 311 of the second motor 31 is coupled to and drives a rotating axle 331 of the sanding drum 33 for grinding the workpiece 11. The elevating member 4 includes a handwheel 41 and a screw rod 42. The screw rod 42 has two ends connected to the housing 32 and the handwheel 41, respectively, so as to adjust the height of the grinding member 3 relative to the feeding member 2 by rotation of the handwheel 41.

Since the feeding member 2 and the sanding drum 33 are driven by the first and second motors 21,31, respectively, during grinding operation, power consumption is relatively high power source. Moreover, height adjustment of the grinding member 3 requires much effort since the grinding member 3 is associated with the second motor 31.

SUMMARY OF THE INVENTION

The object of the present invention is to provide a rotary grinding machine which has a rotary grinding member and a workpiece feeding member that are driven by the same motor through a simplified transmission construction so as to achieve power economy.

According to this invention, the rotary grinding machine includes a mounting frame having lower and upper frame portions which are spaced apart from each other in an upright direction. A rotary grinding member is mounted rotatably on the upper frame portion to define a rotating axis in a longitudinal direction transverse to the upright direction. A feeding member is disposed under the rotary grinding member, and is movable relative to the rotary grinding member in the upright direction between operating and non-operating positions. The feeding member includes a roller extending in the longitudinal direction and having a coupling head. A motor is mounted on the mounting frame and has an output shaft for delivering a first drive force with an output speed. A drive transmission mechanism is disposed to transmit the first drive force of the output shaft to the rotary grinding member so as to rotate the rotary grinding member about the rotating axis with a rotating speed that corresponds to the output speed. A reduction gear mechanism is coupled with the output shaft so as to deliver a second drive force with a reduced speed that is lower than the output speed. A transmission shaft is rotatably mounted on the mounting frame, and has right and left shaft ends opposite to each other in the longitudinal direction. The right shaft end is coupled to the reduction gear mechanism so as to permit the second drive force to be transmitted to the transmission shaft, thereby rotating the left shaft end with the reduced speed about a shaft axis that is parallel to the rotating axis. An endless tensible transmission member is disposed to be trained on the left shaft end of the first transmission shaft and the coupling head. The endless tensible transmission member includes a deflectable segment which runs between the left shaft end and the coupling head, and which is of such a dimension as to place the deflectable segment in a slackened state so as to permit position varying of the coupling head relative to the left shaft end when the feeding member is moved between the operating and non-operating positions. A tensioning mechanism is disposed to place the deflectable segment in a tensed state such that an operating tension of the endless tensible transmission member is maintained, thereby enabling effective transmission of the second drive force to rotate the coupling head.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
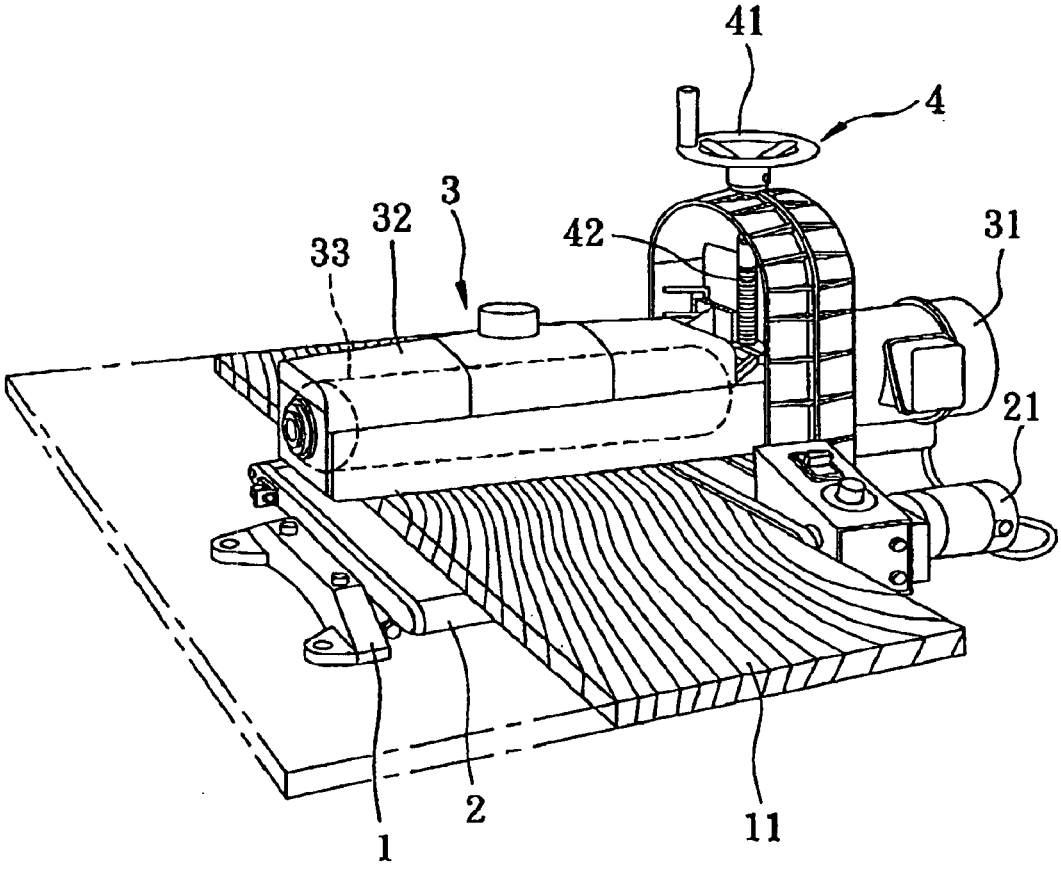
FIG. 1 PRIOR ART
FIG. 1 is a perspective view of a conventional grinding machine.
Figure 2:
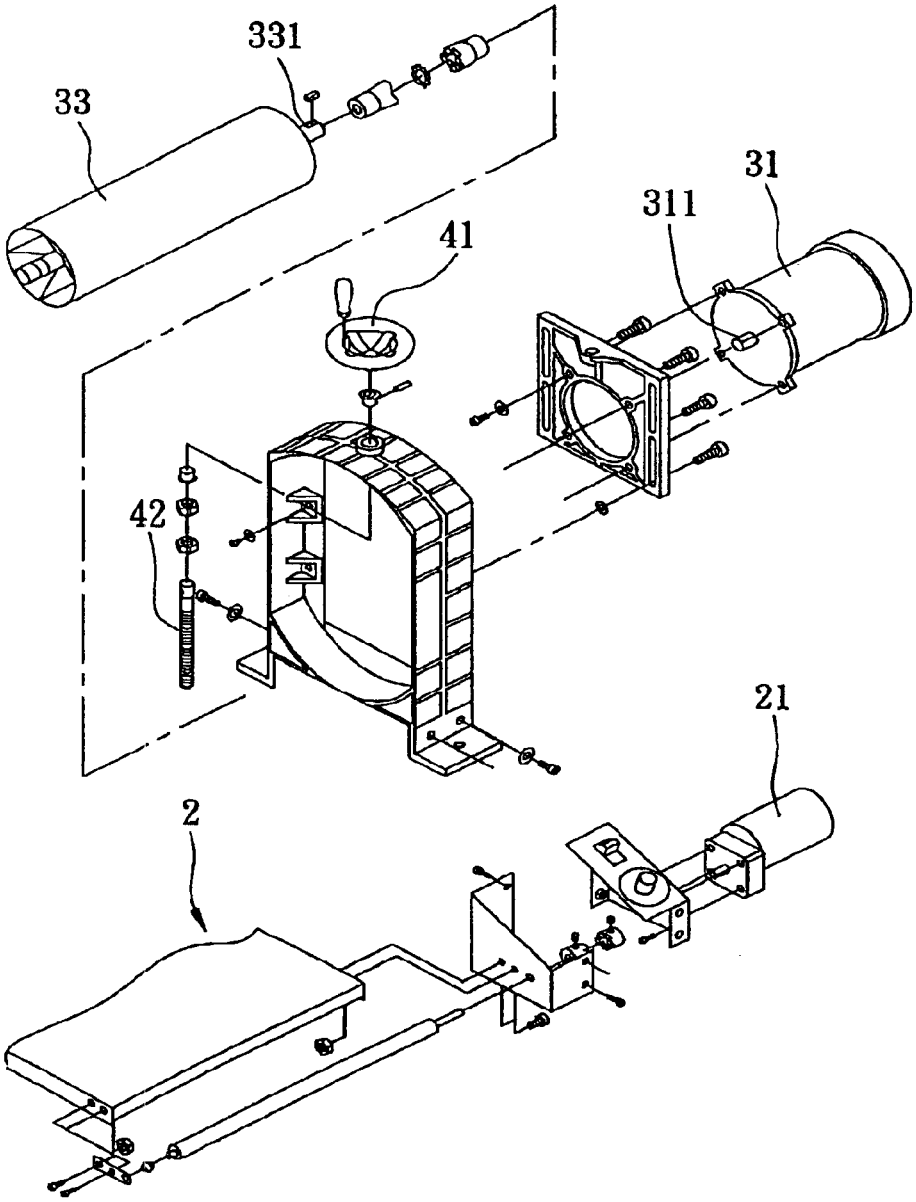
FIG. 2 PRIOR ART
FIG. 2 is an exploded perspective view of a portion of the conventional grinding machine.
Figure 3:
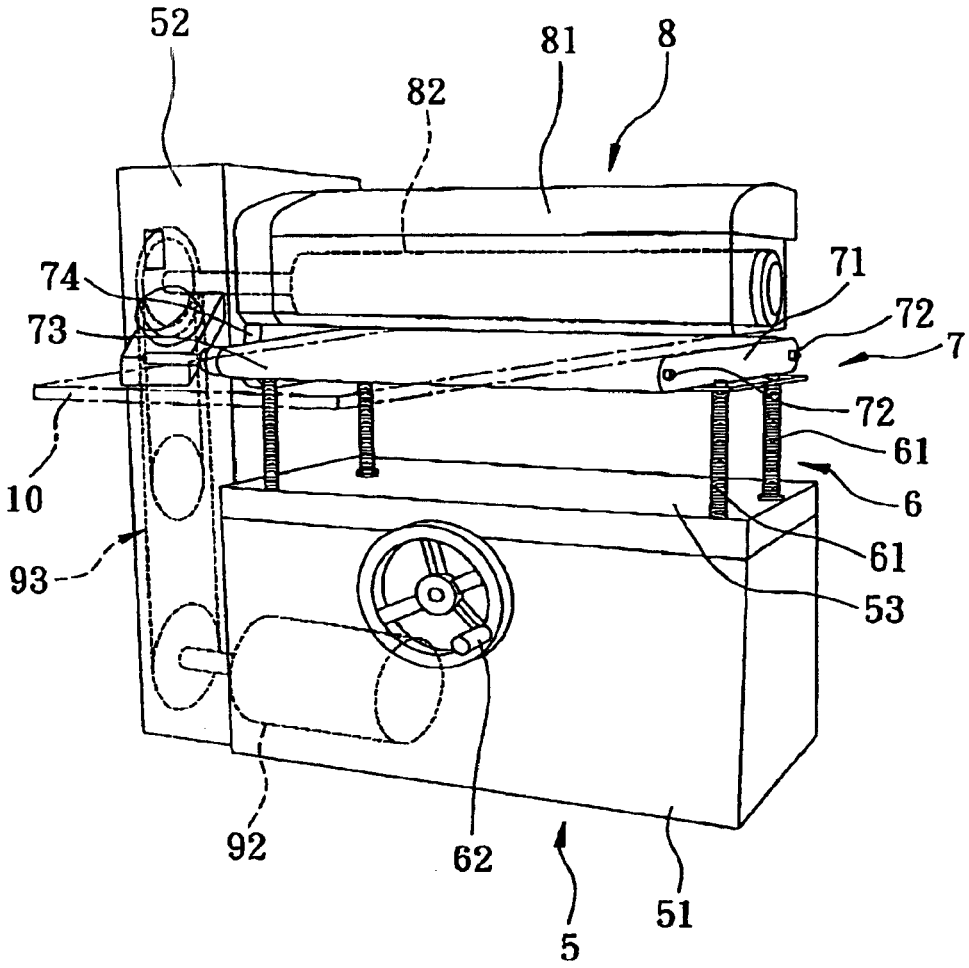
FIG. 3 is a perspective view of the preferred embodiment of a rotary grinding machine according to this invention.
Figure 4:
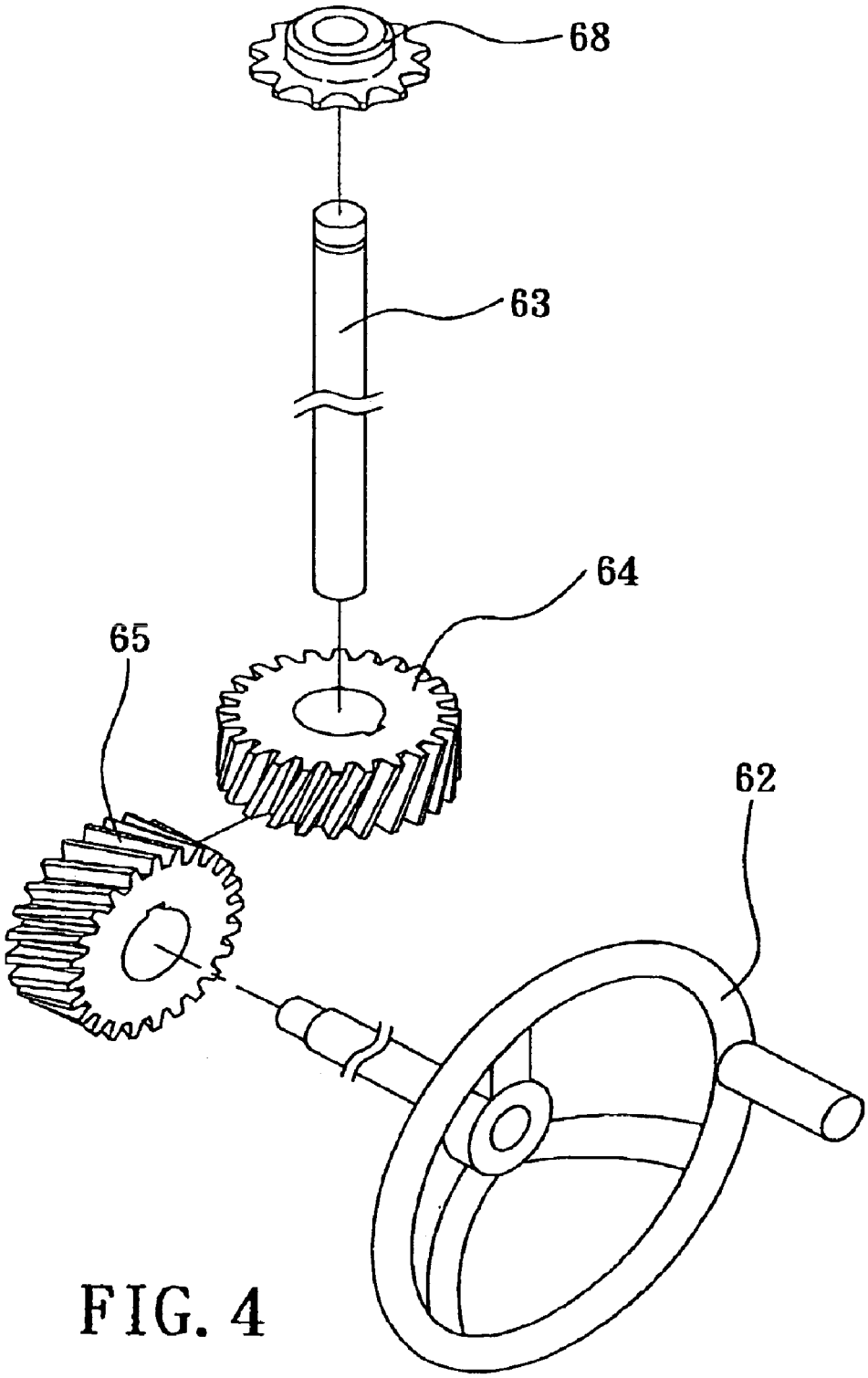
FIG. 4 is an exploded perspective view of a portion of an elevating member of the preferred embodiment.
Figure 5:
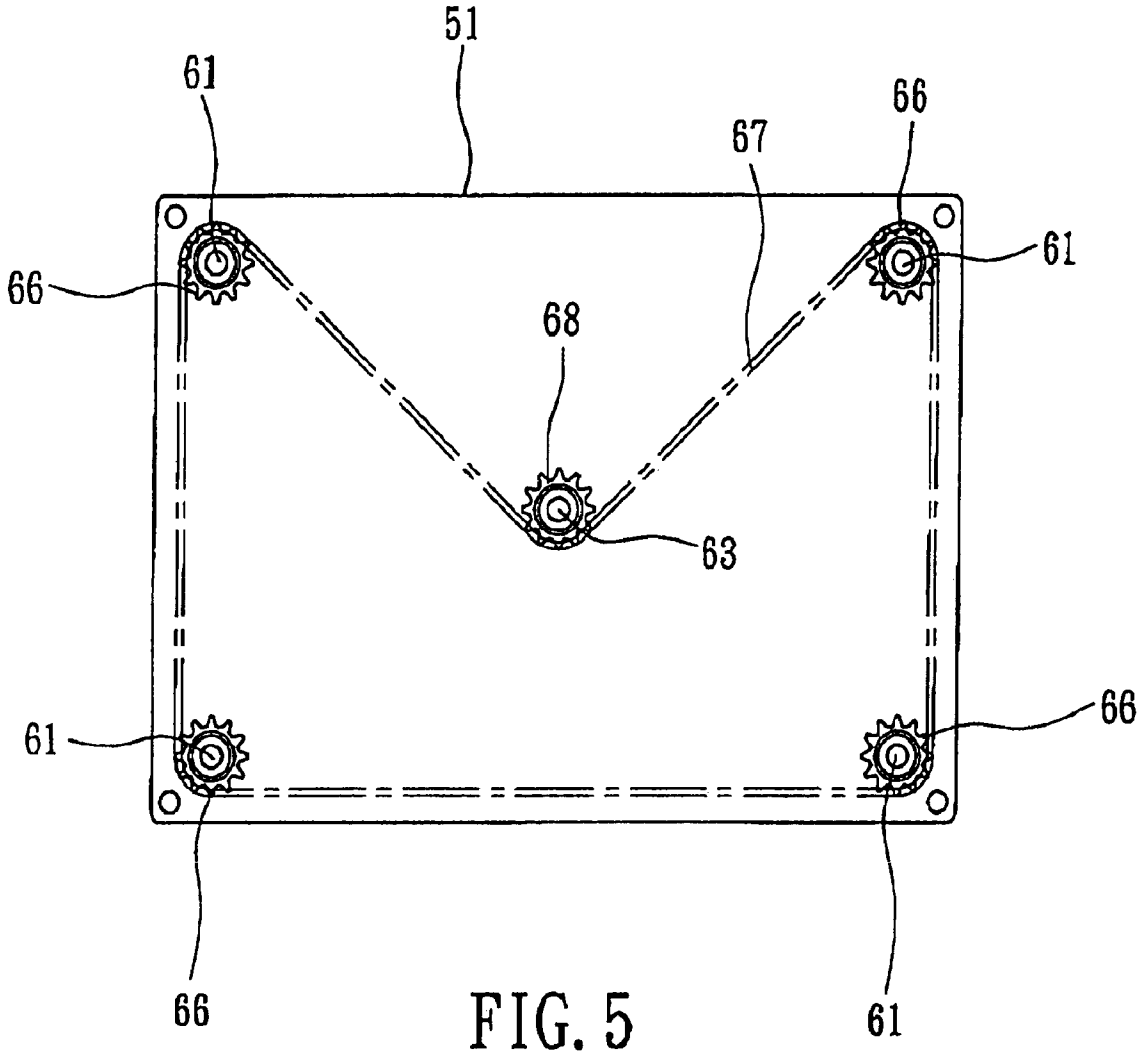
FIG. 5 is a schematic bottom view illustrating the elevating member of the preferred embodiment.

Referring to FIGS. 3 to 5, the preferred embodiment of a rotary grinding machine according to the present invention is shown to comprise a mounting frame 5, a grinding device 8, a workpiece feeding member 7, an elevating member 6, and a motor 92.

The mounting frame 5 has a hollow lower frame portion 51 and an upright side wall 52 mounted on one side of the lower frame portion 51.

The grinding device 8 includes an upper frame portion 81 which is connected to the upright side wall 52 and which is spaced apart from the lower frame portion 51 in an upright direction, and a rotary grinding member 82, such as a sanding drum, which is rotatably mounted on the upper frame portion 81 to define a rotating axis in a longitudinal direction transverse to the upright direction, and which is partially exposed outwardly of the upper frame portion 81 so as to grind a workpiece 10, such as a wooden board.

The feeding member 7 is disposed under the rotary grinding member 82, and is movable relative to the rotary grinding member 82 in the upright direction between operating and non-operating positions. The feeding member 7 includes a support frame 71, first and second rollers 72 which extend in the longitudinal direction, which are rotatably mounted on the support frame 71, and which are spaced apart from each other in a transverse direction transverse to the upright and longitudinal directions to be located at rear and front sides of the feeding member 7, respectively, and a feeding belt 73 which is trained on the first and second rollers 72 and which defines a feeding course from the second roller 72 to the first roller 72 for feeding the workpiece 10 thereon. Furthermore, the first roller 72 has a coupling head 721 (see FIG. 8) which extends towards the upright side wall 52.

The elevating member 6 includes four screw rods 61, each of which has an upper end secured to the support frame 71, and a lower end movably mounted on the lower frame portion 51 in the upright direction, four driven gears 66 which threadedly engage the lower ends of the screw rods 61, respectively, a transmission rod 63 which extends in the upright direction, and which has a transmission end coupled with a transmission gear 68 that is rotatable about an upright axis, and an actuated end which is coupled to a handwheel 62 through driving and driven gears 65,64, such as helical gears, so as to be operable externally to rotate the transmission gear 68 about the upright axis, and a transmission chain 67 which is trained on the four driven gears 66 and the transmission gear 68 to transmit rotating force of the transmission gear 68 to the driven gears 66 so as to synchronously move the screw rods 61 in the upright direction, thereby moving the support frame 71 between the operating and non-operating positions.

In addition, a dust cover 53 is disposed to cover the top of the lower frame portion 51 so as to prevent wood shavings produced during a grinding operation from falling into the lower frame portion 51 to interfere with the operation of the elevating member 6.

Figure 6:
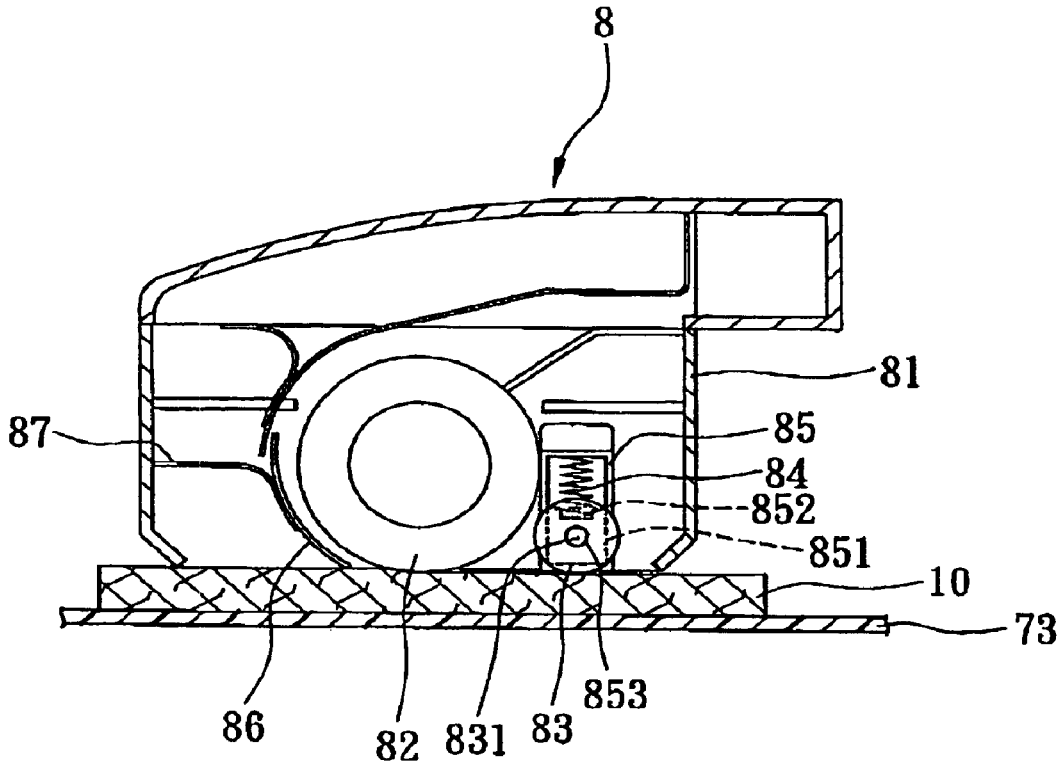
FIG. 6 is a fragmentary sectional view illustrating a grinding member of the preferred embodiment in a state where a workpiece is supported on a feeding member.

Referring to FIG. 6, a rollable body 83 is suspended from the upper frame portion 81 for facilitating feeding of the workpiece 10. In particular, two hollow bodies 85 (only one is shown) are respectively mounted on right and left sides of the upper frame portion 81. Each hollow body 85 has a sliding portion 851 movably mounted therein. The rollable body 83 has two ends 831 which are rollably and respectively mounted in holes 853 in the sliding portions 851 of the hollow bodies 85. Two biasing springs 84 are respectively mounted in the hollow bodies 85 to abut against recesses 852 in the sliding portions 851. Thus, the rollable body 83 is movable downwardly of the upper frame portion 81 to a depressing position where the rollable body 83 rollably engages the workpiece 10 supported on the feeding belt 73 so as to stabilize the feeding course.

Figure 7:
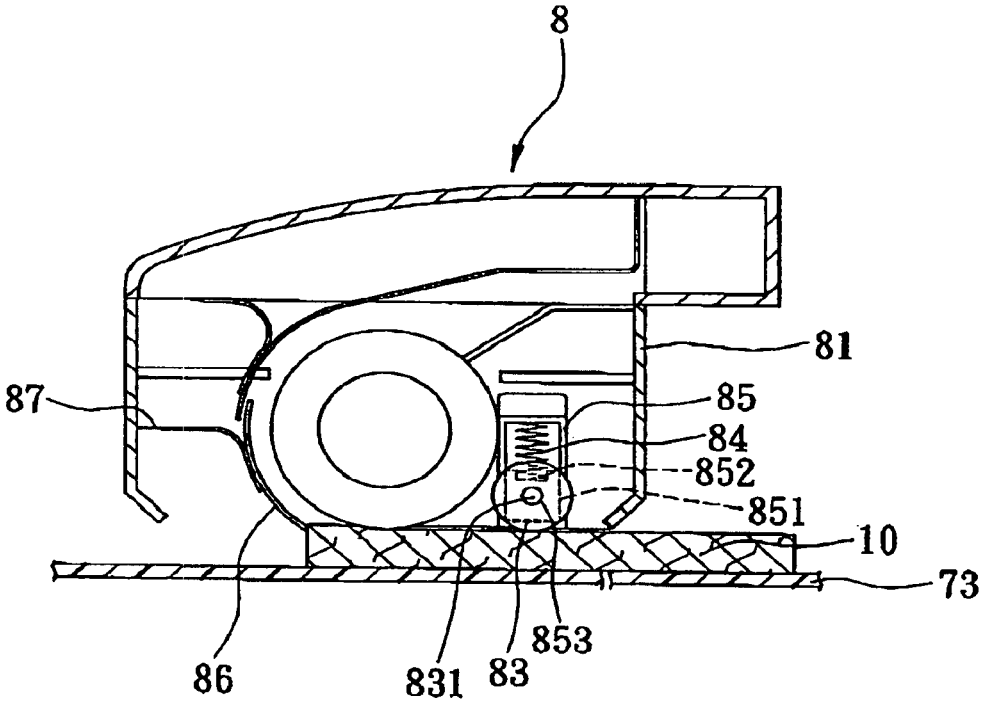
FIG. 7 is a fragmentary sectional view illustrating how a workpiece on the feeding member is retained by a catch tongue.

Referring further to FIG. 7, an arcuate metal catch tongue 86 is mounted on the upper frame portion 81 by means of two positioning plates 87 (only one is shown), and has a lower end extending downwardly of the upper frame portion 81 so as to be in contact with the workpiece 10 on the feeding belt 73. The catch tongue 86 is disposed to prevent movement of the workpiece 10 in a reverse direction opposite to the feeding course, thereby preventing undesired removal of the workpiece 10 from the feeding belt 73 when feeding is interrupted, e.g. when the feeding belt 73 is broken.

Figure 10:
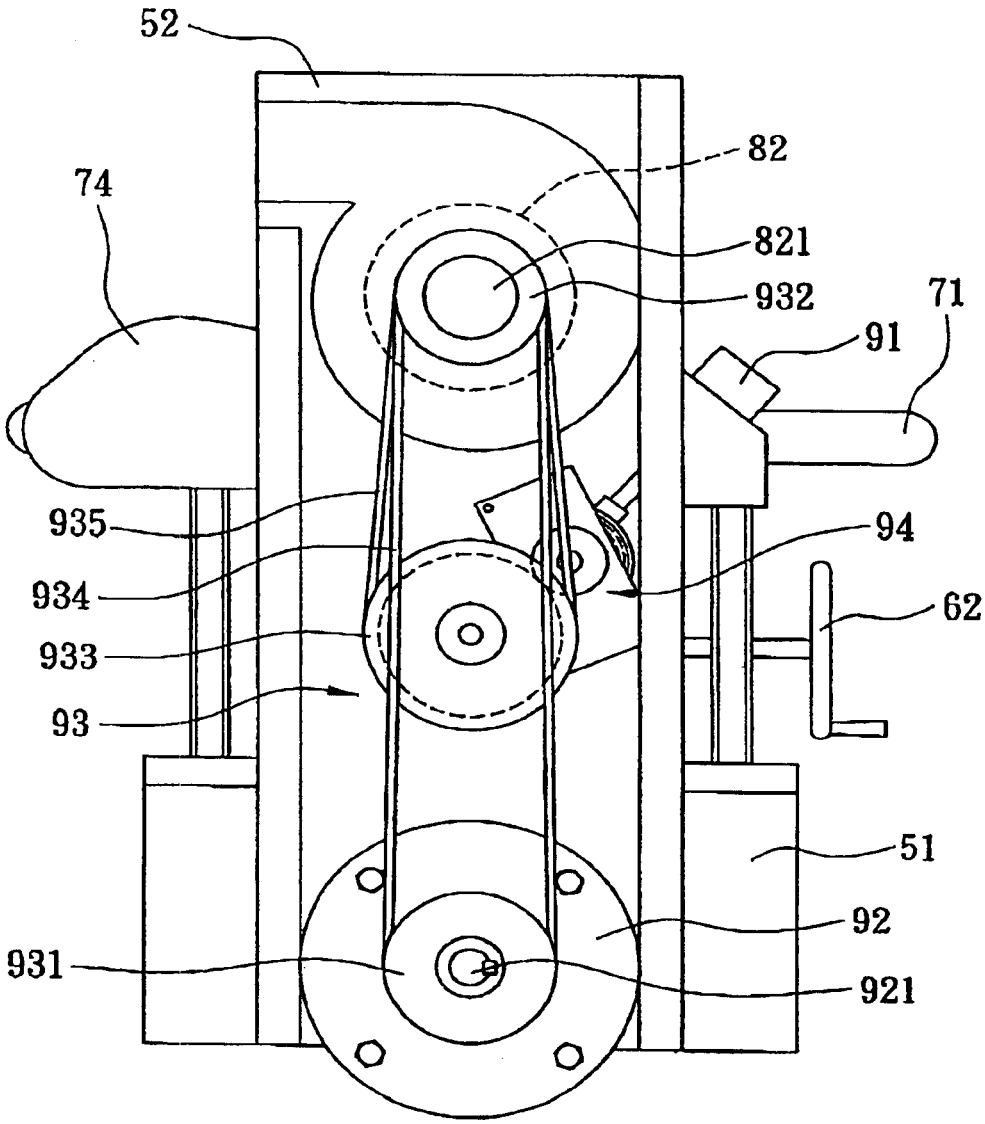
FIG. 10 is a schematic side view of a drive transmission mechanism of the preferred embodiment.

Referring to FIGS. 3 and 10, the motor 92 is mounted on the lower frame portion 51, and has an output shaft 921 for delivering a first drive force with an output speed.

A drive transmission mechanism 93 includes a first pulley 931 which is mounted on and which is rotated with the output shaft 921 of the motor 92, a second pulley 932 which is mounted on and which is rotated with an axle 821 of the rotary grinding member 82 about the rotating axis, and a first belt 934 which is trained on the first and second pulleys 931,932 so as to transmit the first drive force of the output shaft 921 to the rotary grinding member 82 to rotate the rotary grinding member 82 about the rotating axis with a rotating speed that corresponds to the output speed.

Figure 11:
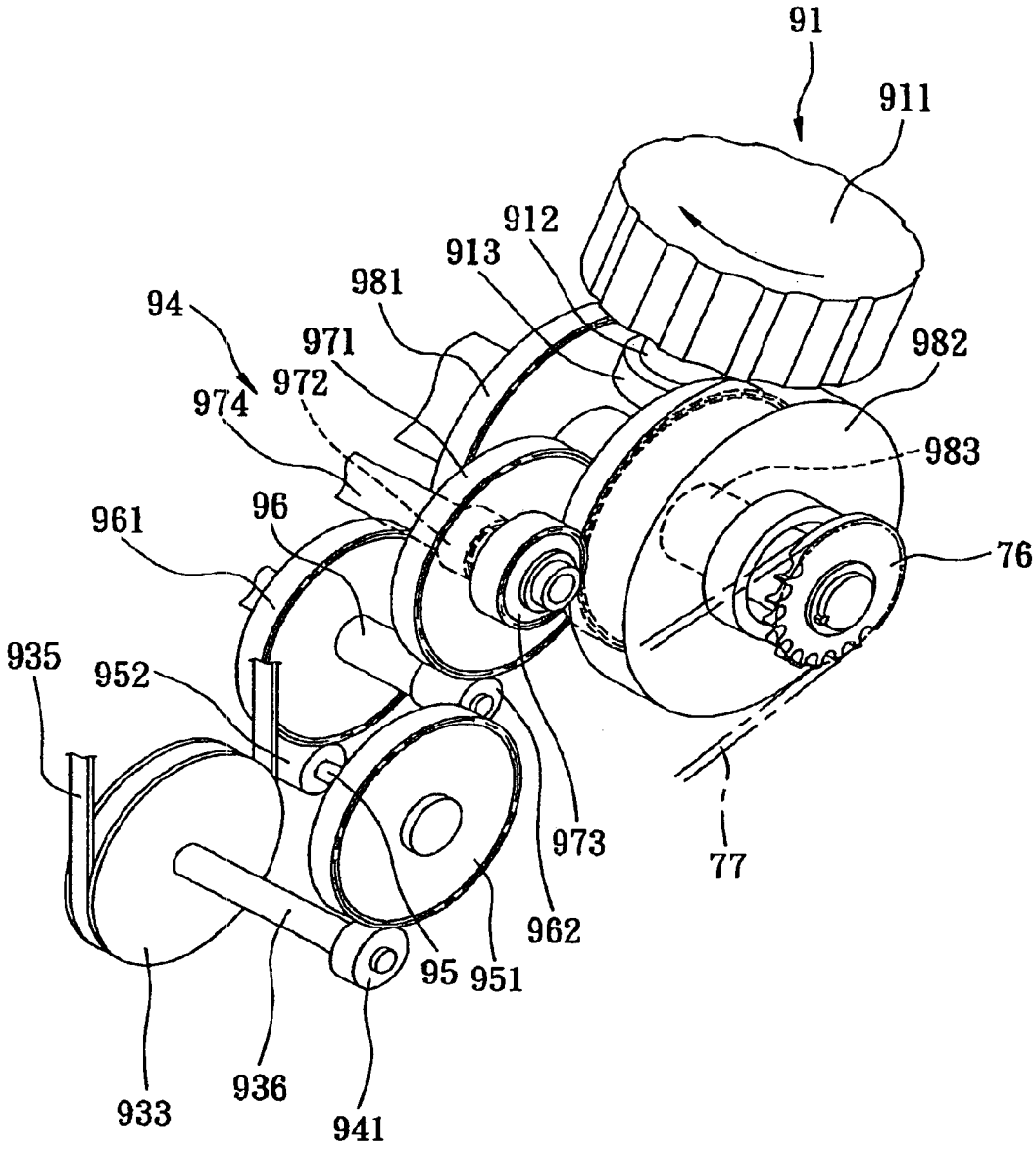
FIG. 11 is a fragmentary perspective view of a reduction gear mechanism of the preferred embodiment.

Referring to FIGS. 10 and 11, a reduction gear mechanism 94 includes a gear train unit which has an input pulley 933, a second belt 935 which is trained on the second pulley 932 and the input pulley 933 so as to couple the reduction gear mechanism 94 with the output shaft 921 of the motor 92. A first transmission shaft 983 is rotatably mounted on the upright side wall 52, and has right and left shaft ends opposite to each other in the longitudinal direction. The gear train unit of the reduction gear mechanism 94 further includes a gear 941 which is coupled with the input pulley 933 through an axle shaft 936, a second transmission shaft 95 which is driven to rotate by the gear 941 through a larger gear 951, a third transmission shaft 96 which is driven to rotate through a smaller gear 952 and a larger gear 961 that are meshed with each other, a fourth transmission shaft 974 which has a first gear 971 that is mounted thereon and that meshes with a gear 962 on the third transmission shaft 96, and second and third gears 972,973 that are mounted on the fourth transmission shaft 974 at two opposite sides of the first gear 971, and first and second output gears 981,982 mounted on the right shaft end of the first transmission shaft 983. An operating member 91 includes an elongated actuating rod 912, an operating knob 911 which is retained on and which is operated to rotate one end of the actuating rod 912, and a cam member 913 which is retained on the other end of the actuating rod 912 and which is interposed between the first and second output gears 981,982. Thus, when the actuating rod 912 is rotated, the rotating movement is transformed into the translational movement of the first and second output gears 981,981 between a first position where the first output gear 981 meshes with the second gear 972 to result in a first reduction drive force, and a second position where the second output gear 982 meshes with the third gear 973 to result in a second reduction drive force. Therefore, the reduction gear mechanism 94 can deliver the second or third drive force with a reduced speed that is lower than the output speed to the first transmission shaft 983, thereby rotating the first transmission shaft 983 with the reduced speed about a shaft axis that is parallel to the rotating axis of the rotary grinding member 82.

Figure 8:
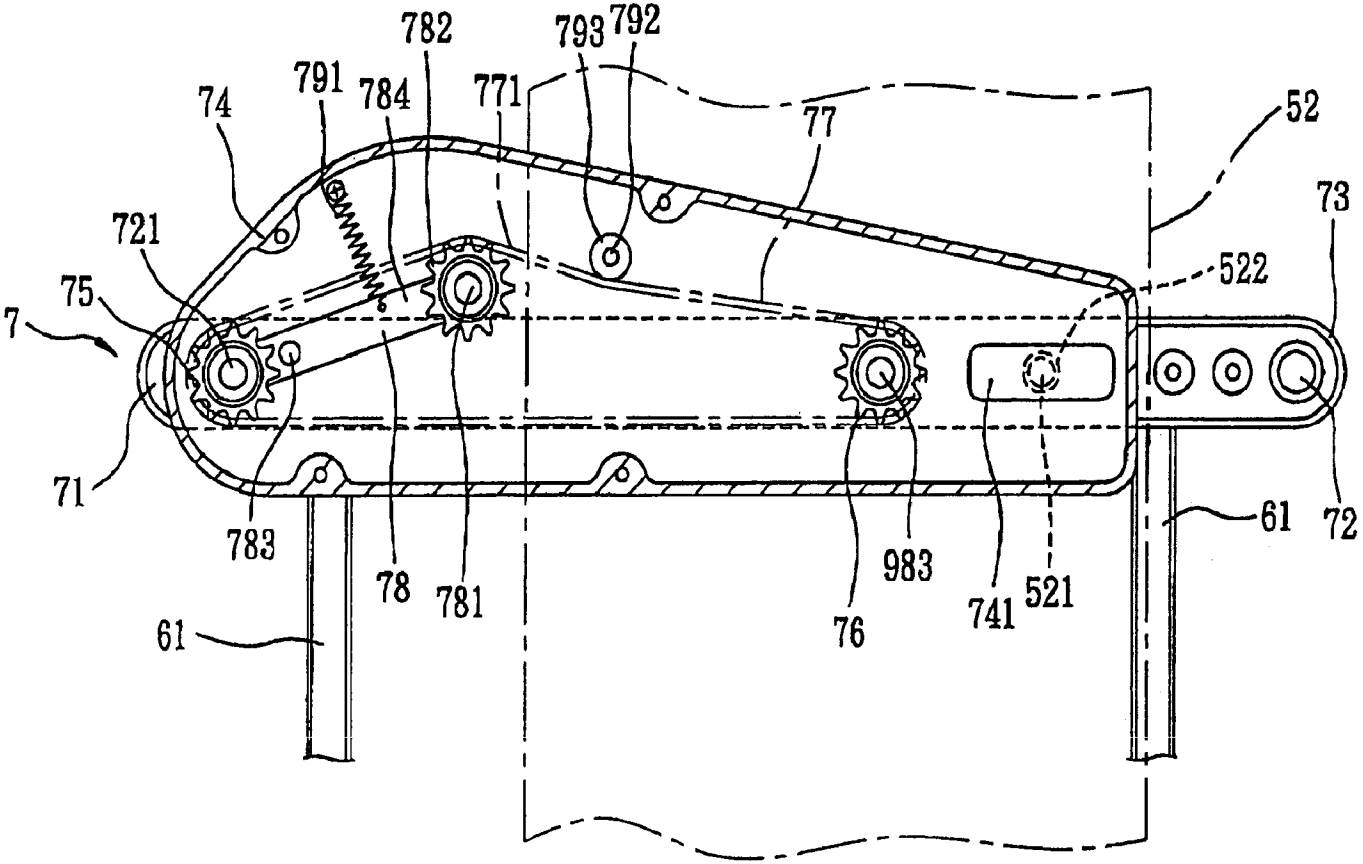
FIG. 8 is a fragmentary sectional view illustrating the feeding member and a tensioning mechanism of the preferred embodiment in a lower position.

Furthermore, referring to FIGS. 8 and 11, the left shaft end of the first transmission shaft 983 and the coupling head 721 of the first roller 72 respectively have first and second chain wheels 76,75 which are rotated with the first transmission shaft 983 and the first roller 72, respectively. An endless tensible transmission member 77, such as an endless chain, is trained on the first and second chain wheels 76,75. The endless tensible transmission member 77 includes a deflectable segment 771 which runs between the left shaft end of the first transmission shaft 983 and the coupling head 721, and which is of such a dimension as to place the deflectable segment 771 in a slackened state so as to permit position varying of the coupling head 721 of the first roller 72 relative to the left shaft end of the first transmission shaft 983 when the feeding member 7 is moved between the operating and non-operating positions. Therefore, due to the arrangement of the chain wheels 76,75 and the endless tensible transmission member 77, power can be transmitted to move the feeding belt 73 of the feeding member 7 along the feeding course.

Figure 9:
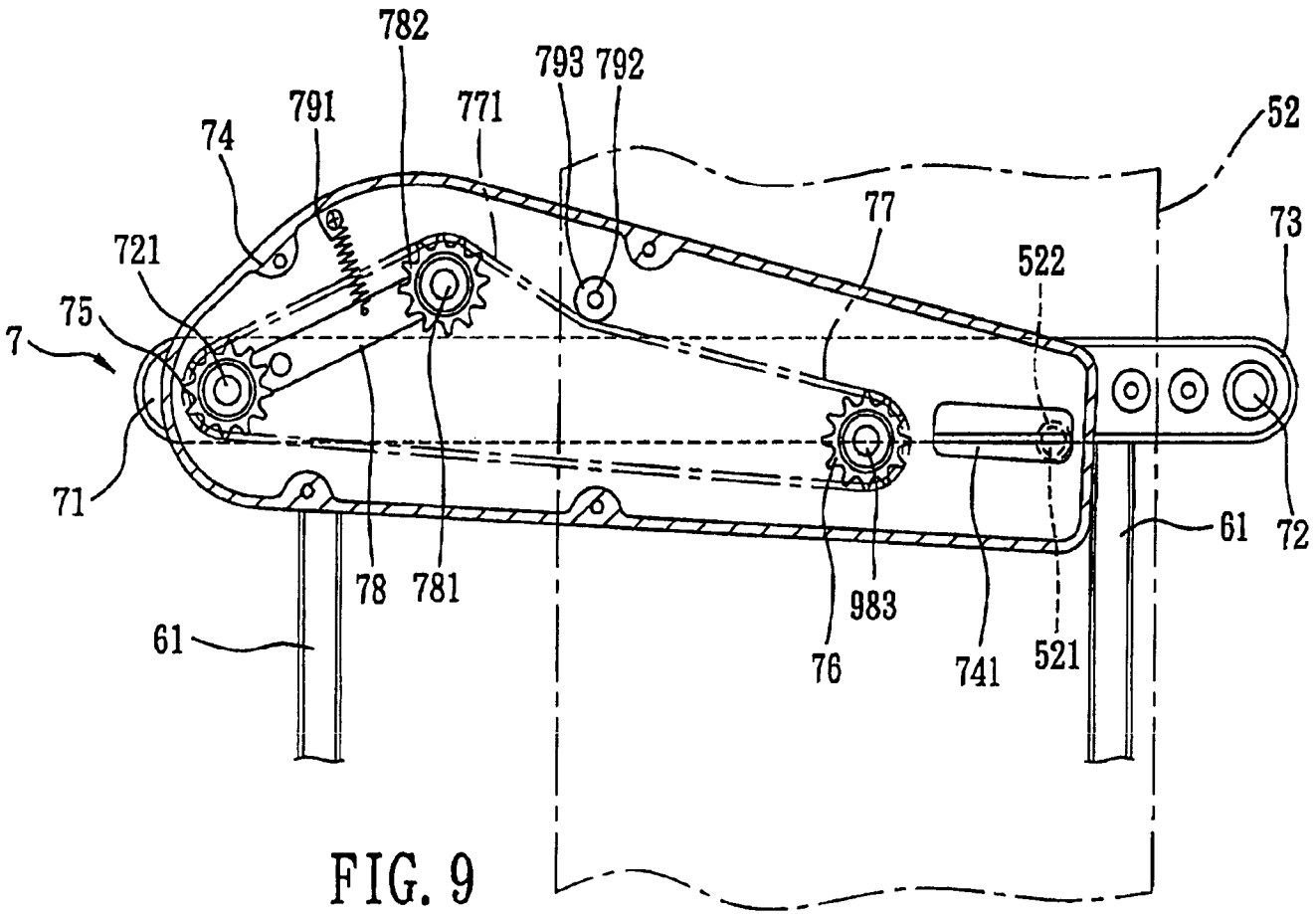
FIG. 9 is a fragmentary sectional view illustrating the feeding member and the tensioning mechanism in an upper position.

Referring once again to FIGS. 8 and 9, to maintain an operating tension of the endless tensible transmission member 77, a tensioning mechanism is provided. The tensioning mechanism includes a side frame 74 which is mounted between the upper frame portion 81 and the upright side wall 52 (see FIG. 3) and which has a rear portion for insertion of the coupling head 721 of the first roller 72 therein so as to be moved with the first roller 72 when the feeding member 7 is moved in the upright direction, and a front side portion with an opening 741 such that a bearing 521 with a sleeve 522 is disposed on the upright side wall 52 and extends through the opening 741 for supporting the front side portion of the side frame 74. A lever 78 has a fulcrum end 783 which is pivotally mounted to the side frame 74 proximate to the first roller 72, and which is pivoted about a pivot axis that is parallel to the rotating axis of the rotary grinding member 82, a weight end 781 which is opposite to the fulcrum end 783 and which is distal from the first roller 72, and a force segment 784 which is interposed between the fulcrum and weight ends 783,781. A third chain wheel 782 is mounted on the weight end 781, and is rotatable relative to the weight end 781 about a revolving axis parallel to the pivot axis of the lever 78. The third chain wheel 782 is turnable about the pivot axis to an engaging position, where the third chain wheel 782 is brought to deflect the deflectable segment 771 so as to place the deflectable segment 771 in a tensed state A biasing member 791 has two ends which are connected to the side frame 74 and the force segment 784, respectively, and is disposed to bias the third chain wheel 782 towards the engaging position. Furthermore, a bearing member, which includes a bearing 792 and a sleeve 793, is rotatably mounted on the side frame 74 and between the third chain wheel 782 and the first chain wheel 76, and is disposed to engage the deflectable segment 771 at an opposite side of the deflectable segment 771 relative to the third chain wheel 782 so as to maintain the operating tension of the endless tensible transmission member 77, thereby enabling effective transmission of the second or third drive force to rotate the coupling head 721 of the first roller 72.

As illustrated, according to this invention, the rotary grinding member 82 and the feeding member 7 of the rotary grinding machine are driven by the same motor 92, thereby resulting in power economy. In addition, by means of the elevating member 6, the feeding member 7 can be adjusted to a desired position relative to the rotary grinding member 82 without the need to elevate the motor 92 as in the prior art.

Figure 12:
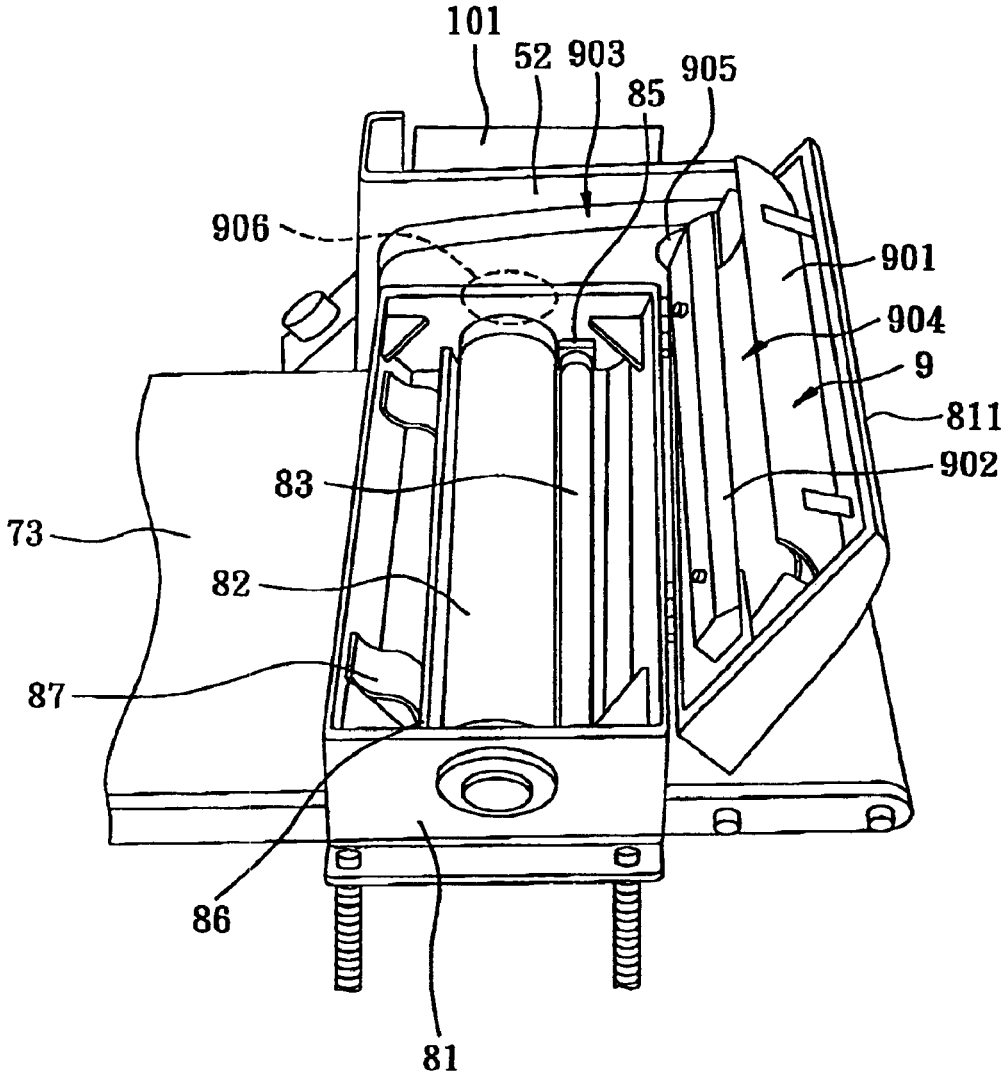
FIG. 12 is a fragmentary perspective view of a dust collecting mechanism of the preferred embodiment.
Figure 13:
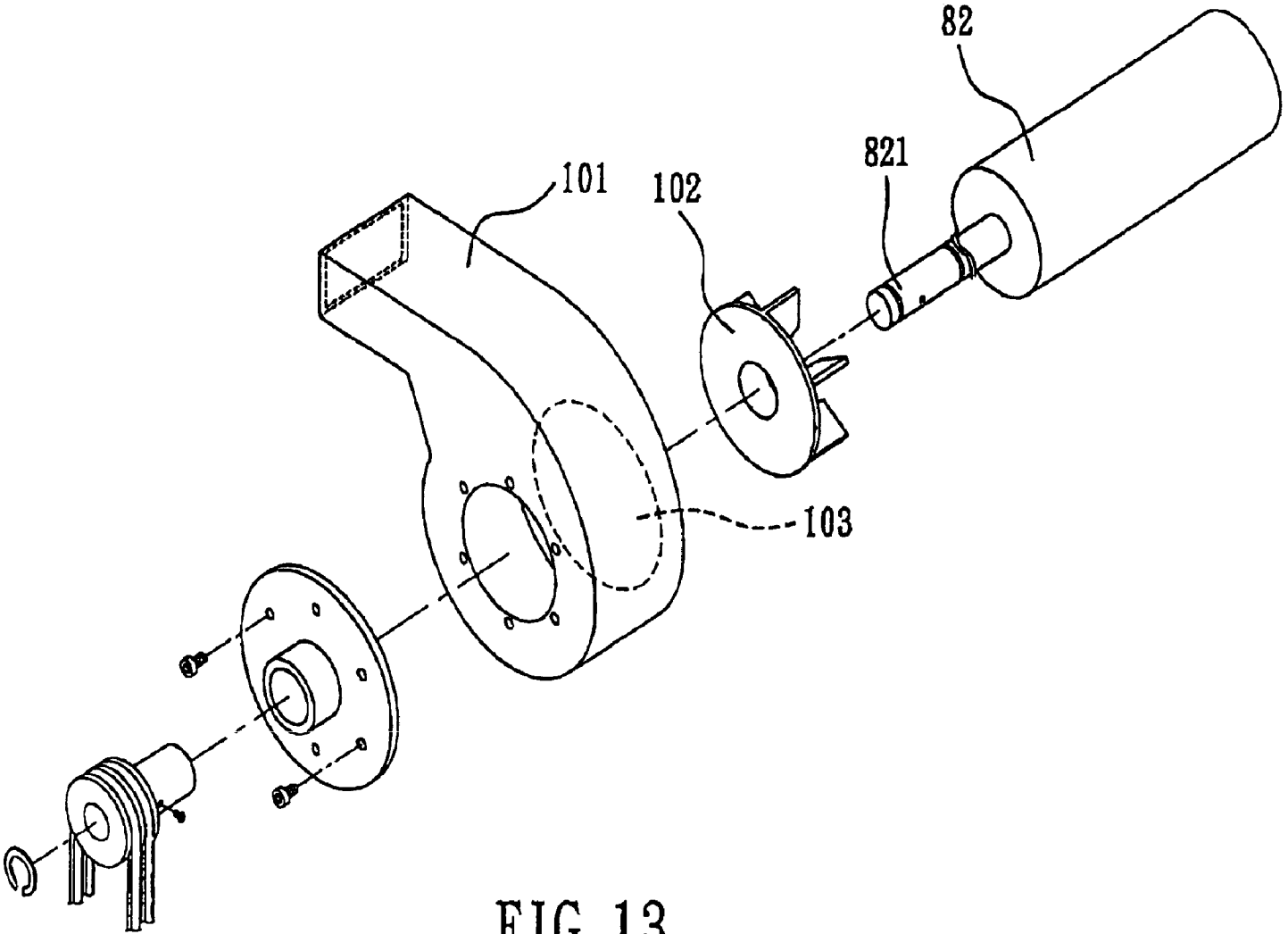
FIG. 13 is an exploded perspective view of the dust collecting mechanism of the preferred embodiment.
Figure 14:
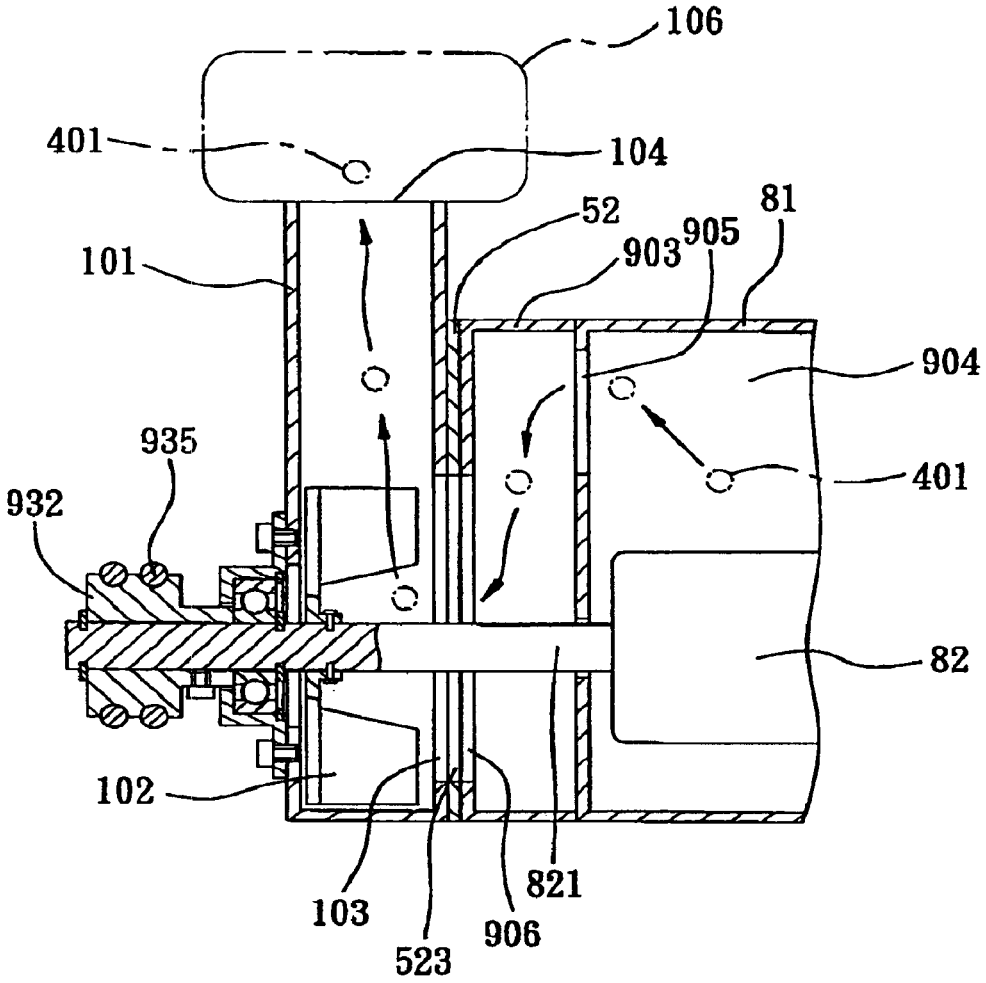
FIG. 14 is a fragmentary sectional view of the preferred embodiment in a dust collecting state.

Preferably, referring to FIGS. 12 to 14, the rotary grinding machine according to this invention further comprises a dust collecting mechanism 9 provided adjacent to the rotary grinding member 82. The dust collecting mechanism 9 includes a barrier plate 901 and a positioning plate 902, which are disposed on a cover 811 of the upper frame portion 81 to define a dust collecting space 904 for collecting dust 401. A hollow dust guiding member 903 is mounted between the upper frame portion 81 and the upright side wall 52, and defines a dust passageway that is communicated with the dust collecting space 904 through an intake port 905. The dust guiding member 903 has an outlet hole 906 which is communicated with a through hole 523 in the upright side wall 52. A blower casing 101 has proximate and distal walls opposite to each other in the longitudinal direction to define a casing space therebetween, and a discharging port 104 which is disposed between the proximate and distal walls. The proximate wall has an inlet port 103 which engages the through hole 523 so as to communicate the dust passageway with the casing space. The axle 821 of the rotary grinding member 82 extends through the outlet hole 906, the through hole 523 and the inlet port 103, and is coupled with an impeller 102 received in the casing space such that the impeller 102 is rotated with the axle 821 about the rotating axis so as to draw the dust 401 from the dust passageway into the casing space for discharge through the discharging port 104. A dust bag 106 is preferably coupled with the discharging port 104 for dust disposal.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

We claim:

1. A rotary grinding machine comprising:

a mounting frame having lower and upper frame portions spaced apart from each other in an upright direction;

a rotary grinding member mounted rotatably on said upper frame portion to define a rotating axis in a longitudinal direction transverse to the upright direction;

a feeding member disposed under said rotary grinding member and movable relative to said rotary grinding member in the upright direction between operating and non-operating positions, said feeding member including a first roller extending in the longitudinal direction and having a coupling head;

a motor mounted on said mounting frame and having an output shaft for delivering a first drive force with an output speed;

a drive transmission mechanism disposed to transmit the first drive force of said output shaft to said rotary grinding member so as to rotate said rotary grinding member about the rotating axis with a rotating speed that corresponds to the output speed;

a reduction gear mechanism disposed to be coupled with said output shaft so as to deliver a second drive force with a reduced speed that is lower than the output speed;

a first transmission shaft rotatably mounted on said mounting frame, and having right and left shaft ends opposite to each other in the longitudinal direction, said right shaft end being coupled to said reduction gear mechanism so as to permit the second drive force to be transmitted to said first transmission shaft, thereby rotating said left shaft end with the reduced speed about a shaft axis that is parallel to the rotating axis;

an endless tensible transmission member disposed to be trained on said left shaft end of said first transmission shaft and said coupling head, said endless tensible transmission member including a deflectable segment which runs between said left shaft end and said coupling head, and which is of such a dimension as to place said deflectable segment in a slackened state so as to permit position varying of said coupling head relative to said left shaft end when said feeding member is moved between the operating and non-operating positions; and a tensioning mechanism disposed to place said deflectable segment in a tensed state such that operating tension of said endless tensible transmission member is maintained, thereby enabling effective transmission of the second drive force to rotate said coupling head.

2. The rotary grinding machine of claim 1, wherein said left shaft end and said coupling head respectively have first and second chain wheels which are rotated with said first transmission shaft and said first roller, respectively, said endless tensible transmission member being an endless chain which is trained on said first and second chain wheels.

3. The rotary grinding machine of claim 2, wherein said tensioning mechanism includes a side frame disposed to be moved with said first roller when said feeding member is moved in the upright direction, a lever having a fulcrum end which is pivotally mounted to said side frame proximate to said first roller, and which is pivoted about a pivot axis that is parallel to the rotating axis, a weight end which is opposite to said fulcrum end and which is distal from said first roller, and a force segment which is interposed between said fulcrum end and said weight end, a third chain wheel mounted on said weight end, and rotatable relative to said weight end about a revolving axis parallel to the pivot axis, said third chain wheel being turnable about the pivot axis to an engaging position, where said third chain wheel is brought to deflect said deflectable segment so as to place said deflectable segment in the tensed state, and a biasing member having two ends which are connected to said side frame and said force segment, respectively, and disposed to bias said third chain wheel towards the engaging position.

4. The rotary grinding machine of claim 3, wherein said tensioning mechanism further includes a bearing member which is rotatably mounted on said side frame between said third chain wheel and said first chain wheel, and which is disposed to engage said deflectable segment at an opposite side of said deflectable segment relative to said third chain wheel so as to maintain the operating tension of said endless chain.

5. The rotary grinding machine of claim 1, wherein said feeding member further includes a support frame for rotatably mounting said first roller, a second roller which is rotatably mounted on said support frame and which is spaced apart from and which is disposed forwardly of said first roller in a transverse direction transverse to the upright and longitudinal directions, and a feeding belt which is trained on said first and second rollers and which defines a feeding course from said second roller to said first roller for feeding a workpiece thereon.

6. The rotary grinding machine of claim 5, further comprising an elevating member which includes a plurality of screw rods, each having an upper end which is secured to said support frame, and a lower end which is movably mounted on said lower frame portion in the upright direction, a plurality of driven gears threadedly engaging said lower ends of said screw rods, respectively, a transmission rod extending in the upright direction, and having a transmitting end which is provided with a transmission gear rotatable about an upright axis, and an actuated end which is operable externally to rotate said transmission gear about the upright axis, and a transmission chain trained on said driven gears and said transmission gear to transmit rotating force of said transmission gear to said driven gears so as to move said screw rods in the upright direction, thereby moving said support frame between the operating and non-operating positions.

7. The rotary grinding machine of claim 1, wherein said drive transmission mechanism includes a first pulley mounted on and rotated with said output shaft of said motor, a second pulley mounted on and rotated with said rotary grinding member about the rotating axis, and a first belt trained on said first and second pulleys so as to transmit the first drive force of said output shaft to said rotary grinding member.

8. The rotary grinding machine of claim 7, wherein said reduction gear mechanism includes a gear train unit which has an input pulley, an output gear that is disposed downstream of said input pulley and that is coupled to said right shaft end, and a second belt trained on said second pulley and said input pulley so as to couple said reduction gear mechanism with said output shaft, thereby permitting the second drive force to be delivered through said right shaft end to said first transmission shaft.

9. The rotary grinding machine of claim 5, further comprising a rollable body which is suspended from said upper frame portion and which is movable downwardly of said upper frame portion to a depressing position where said rollable body is adapted to rollably engage the workpiece to stabilize the feeding course, and a biasing member which is disposed to bias said rollable body towards the depressing position.

10. The rotary grinding machine of claim 5, further comprising a catch tongue which is mounted on said upper frame portion and which is configured to prevent movement of the workpiece in a reverse direction opposite to the feeding course.

11. The rotary grinding machine of claim 1, further comprising a barrier wall disposed in the vicinity of said rotary grinding member, and defining a dust collecting space;

a blower casing having proximate and distal walls which are disposed opposite to each other in the longitudinal direction and which are proximate to and distal from said dust collecting space, respectively, to define a casing space therebetween, and a discharging port which is disposed between said proximate and distal walls, said proximate wall having an inlet port which is disposed to communicate said dust collecting space with said casing space, said rotary grinding member having an axle which is rotatable about the rotating axis and which extends through said inlet port and into said blower casing; and an impeller received in said casing space, and coupled with said axle so as to be rotated with said axle about the rotating axis to draw dust from said dust collecting space into said casing space for discharge through said discharging port.

* * * * *